US005647406A

United States Patent [19]

Pucher

[11] Patent Number: 5,647,406

[45] Date of Patent: Jul. 15, 1997

[54] PROCESS FOR THE MANUFACTURING OF A GRID

[76] Inventor: Manfred Pucher, Triesterstrasse 382, 8055 Graz, Austria

[21] Appl. No.: 387,837

[22] PCT Filed: Feb. 23, 1994

[86] PCT No.: PCT/AT94/00019

§ 371 Date: Feb. 14, 1995

§ 102(e) Date: Feb. 14, 1995

[87] PCT Pub. No.: WO94/20233

PCT Pub. Date: Sep. 15, 1994

[30] Foreign Application Priority Data

Feb. 24, 1993 [AT] Austria ..... 357/93

[51] Int. Cl.[6] ..... B21F 27/00

[52] U.S. Cl. ..... 140/112; 29/897.31

[58] Field of Search ..... 140/7, 112; 29/160

[56] References Cited

U.S. PATENT DOCUMENTS 2,401,319 6/1946 Roemer ..... 140/7

3,427,701 2/1969 McDonnell .

4,328,409 5/1982 Senn ..... 140/112

FOREIGN PATENT DOCUMENTS 0 317 761 5/1989 European Pat. Off. .

11 97 427 7/1965 Germany .

23 20 747 11/1974 Germany .

*Primary Examiner*—Lowell A. Larson

*Attorney, Agent, or Firm*—Henry M. Feiereisen

[57] ABSTRACT

A process and device are disclosed for manufacturing a grid, in particular a pressed grid. The grid consists of a plurality of carrying bars (9) and of filling bars (5) that can be inserted into the carrying bars. Both the carrying bars (9) and the filling bars (5) are supplied by conveyors to a pressing station (3) having a holding device for the carrying bars and an actuating device for receiving and pressing the filling bars to be inserted. After the bars are pressed, the holding device is moved forward over a freely selectable distance and the actuating device is moved so that another filling bar is moved from a supply position to the working position. After all bars which form the grid are pressed, the grid is subjected to a finishing process.

23 Claims, 9 Drawing Sheets

PROCESS FOR THE MANUFACTURING OF A GRID

The present invention relates to a process for manufacturing a grid, in particular a pressed grid, as well as to a device for the manufacturing of such grid.

One aim of the invention is to provide a clean and quick manufacturing of a grid in which the process steps are well coordinated.

It is also an aim of the invention to provide a device for the manufacturing of a grid, in particular a pressed grid, by means of which such a grid can be manufactured in a simple and uncomplicated manner using a few manufacturing steps.

A further aim of the invention is to manufacture a grid free of distortions.

The present invention accomplishes this aim in that the grid consists of a plurality of carrying bars and of filling bars which can be inserted into the carrying bars, in that both the carrying bars and the filling bars are supplied by supply devices to a pressing station, the pressing station having a holding device for the carrying bars and an actuating device for receiving and pressing the filling bars to be inserted, in that, after the bars have been pressed, the holding device is moved forward by a freely selectable distance and the actuating device is moved in such a manner that another filling bar is moved from a supply position to a working position, and in that the grid is subjected to a finishing process after all bars which form the grid are pressed together.

After pressing together of the carrying bars and the filling bars it may also be provided that the removal of the grid from the pressing station is effected by means of a removal conveyor, and that the grid is subsequently provided with a rim profile.

According to the invention there is provided a device for manufacturing a grid, which is characterised in that the pressing station comprises a holding beam for receiving the carrying bars and an actuating device for receiving and pressing in of the filling bars, which actuation device can be rotated against the holding beam, and in that there are provided transport devices for transporting the filling bars as well as for transporting the carrying bars to the corresponding sections in the pressing station.

In further development of the present invention, this device can be arranged in such a manner that the holding beam is provided with grooves for receiving the carrying bars and with a fixing device for fixing the carrying bars, the holding beam preferably having a plurality of parallel grooves.

According to a further embodiment of the invention, the fixing device can be provided by an eccentric clamping device which comprises a press on shaft which fixes the carrying bar in the groove and an actuating element which works together with the press-on shaft.

Advantageously, it is provided that the press-on shaft extends through each groove; in a further embodiment, each press-on shaft extends through the groove in an eccentric fashion with respect to it's cross section.

Advantageously, the press-on shaft comprises on the section which extends through the groove a fixing piece arranged in extension of the shaft body, which fixing piece is preferably a cylindrical segment, the cross section axis of the cylindrical segment extending parallel to the insertion direction of the press-on shaft in the holding beam and extending outside of the groove in the non-fixed position.

According to a further embodiment of the invention, it can be provided that the press-on shaft is provided on the section which works together with the actuating element with a meshing part which is surrounded by a recess in the actuating element, the meshing part being advantageously arranged within the cross section of the shaft.

In accordance with yet another embodiment of the invention, the actuating element is driven hydraulically. Ideally, the actuating element meshes, with the press-on shaft in such a manner that the press-on shaft rotates upon longitudinal movement of the actuating element, therewith fixing the carrying bar in the groove.

The rotation angle can be selected freely and is dependent of the stroke length of the meshing part. This allows to accommodate carrying bars of different diameters within the grooves without any problem.

According to another embodiment of the invention, it can be provided that the press-on shaft assigned to each second groove are arranged in one row.

According to a further development of the invention, it can be provided that the actuating device can comprise a block rotatable about an axis, the block having arranged on its periphery, press-on pliers for receiving the filling bars and herein between located docking devices for fixing the block against a pressing beam which includes the pressing device, the press-in pliers being preferably arranged on the rotatable block at an angular distance from one another at 120°, a first one of the press-in pliers taking over one filling bar, a second one of the press-in pliers being in a waiting position and a third one of the press-in pliers pressing the filling bar together with the carrying bars.

According to a further embodiment of the invention, it is provided that a plurality of press-in pliers are arranged one behind the other in longitudinal direction of the block and the filling beam.

An advantageous embodiment of the invention is also given in that the press-on shafts assigned to the adjacently, side-by-side arranged grooves have actuating directions which are opposite to one another.

It can also be provided according to the invention that the press-in pliers are actuated by press-in cylinders which preferably are arranged on the pressing beam which fixes the rotatable block during the press-in operation.

According to yet another embodiment there can be provided a device with two holding beams separated from one another by a support for the press-in pliers, the carrying bars being fixed during the first pressing step, but preferably during the first two pressing steps, by the first holding beam and during all remaining pressing steps by the second holding beam, the first holding beam serving as a guide for the carrying bars.

A development of the device is characterised in that the fixed state of the carrying bars is kept during the pressing and the forwarding step.

The invention will be described in the following based on an embodiment thereof and with reference to the enclosed drawings, wherein.

Figure 1:
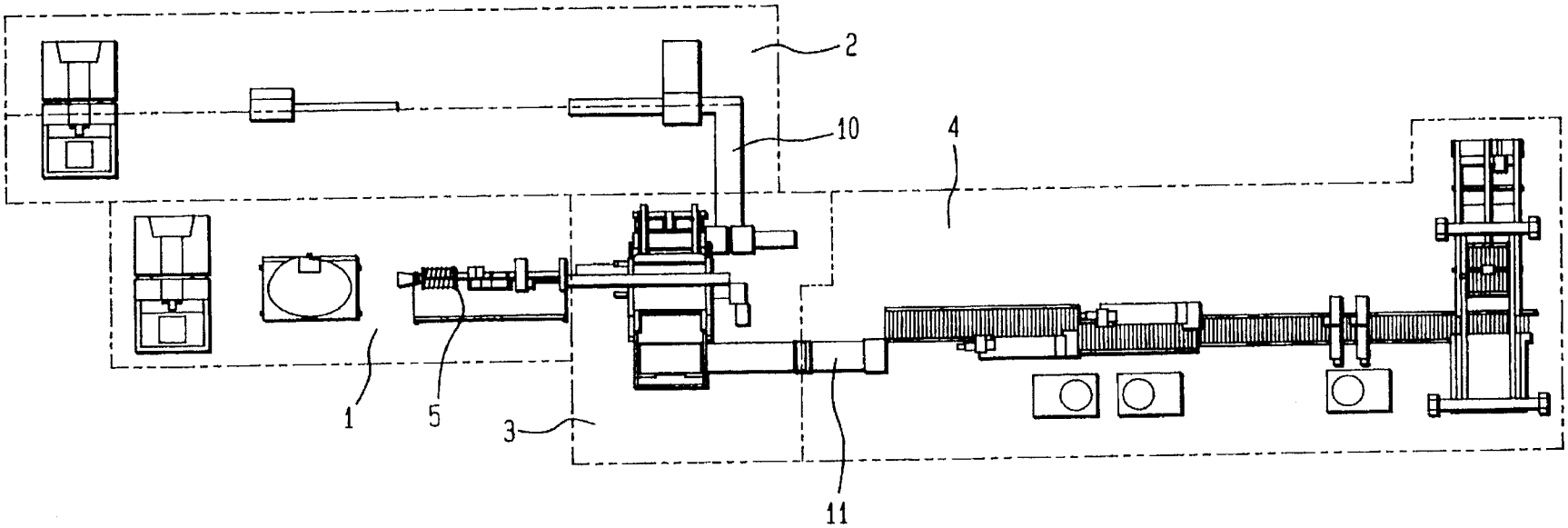
FIG. 1 shows a production line for manufacturing of grids.

FIG. 1 shows the whole production line which essentially comprises four (4) assembly groups. The line is subdivided into the filling bar supply 1, the carrying bar supply 2, the pressing station 3, and the welding and piling station 4.

The filling bars 5 are taken from a flat bar reel, with a maximum weight of up to 2,5t or from a ring.

A device for reeling off the reel or the ring is provided by means of which the flat bar is transported to the straightening station 6.

The length of the filling bar 5 is set depending on the grid site of the pressed grid and is correspondly cut-off by a conventional cutting tool. The filling bar obtained in this manner reaches via a transport line the pressing station 3, in which, after an alignment in longitudinal direction, it is taken over by the press-in pliers 7 of the actuating device 8 of the pressing station 3.

The feeding of the carrying bar 9 is initially also accomplished by means of a reeling-off device. The carrying bar subsequently travels through a straightening station, a slit press in which the slits for inserting the filling bars are made, and a cutting tool in which the bar is cut to its preselected length. Subsequently, the pre-manufactured carrying bar is transported into a carrying bar magazine. The carrying bars can be transported automatically or by hand into the carrying bar magazine from which the carrying bars are pushed in a timed sequence into the carrying bar feeding carriage which transports the carrying bars into the pressing station 3.

After the carrying bars and filling bars have been pressed together, the finalised grid is taken over by the removal/handling device and placed on a removal band 11. The grid reaches via this section a station in which it is bordered with a rim profile or beam by hand and then welded with the end corners. The grid is subsequently pushed by a worker into a conveyor roller line via which the grid reaches the welding station 4. The grid is positioned and secured (clamped) within the welding station 4 and subsequently a longitudinal edge thereof is measured with an optical feeler in order to determine the amount of welding points required. After this step, the gutter grid is welded using MIG-MAG. There are provided four (4) welding stations, the grid being rotated in each case by 90° by a rotating station.

After welding, the finalised grid is taken to a stapling station in which the grid is oriented and stapled. After reaching a predetermined staple height, the staple is transferred automatically into a removal position from which it can be removed by means of, for example, a fork lifter.

Figure 2:
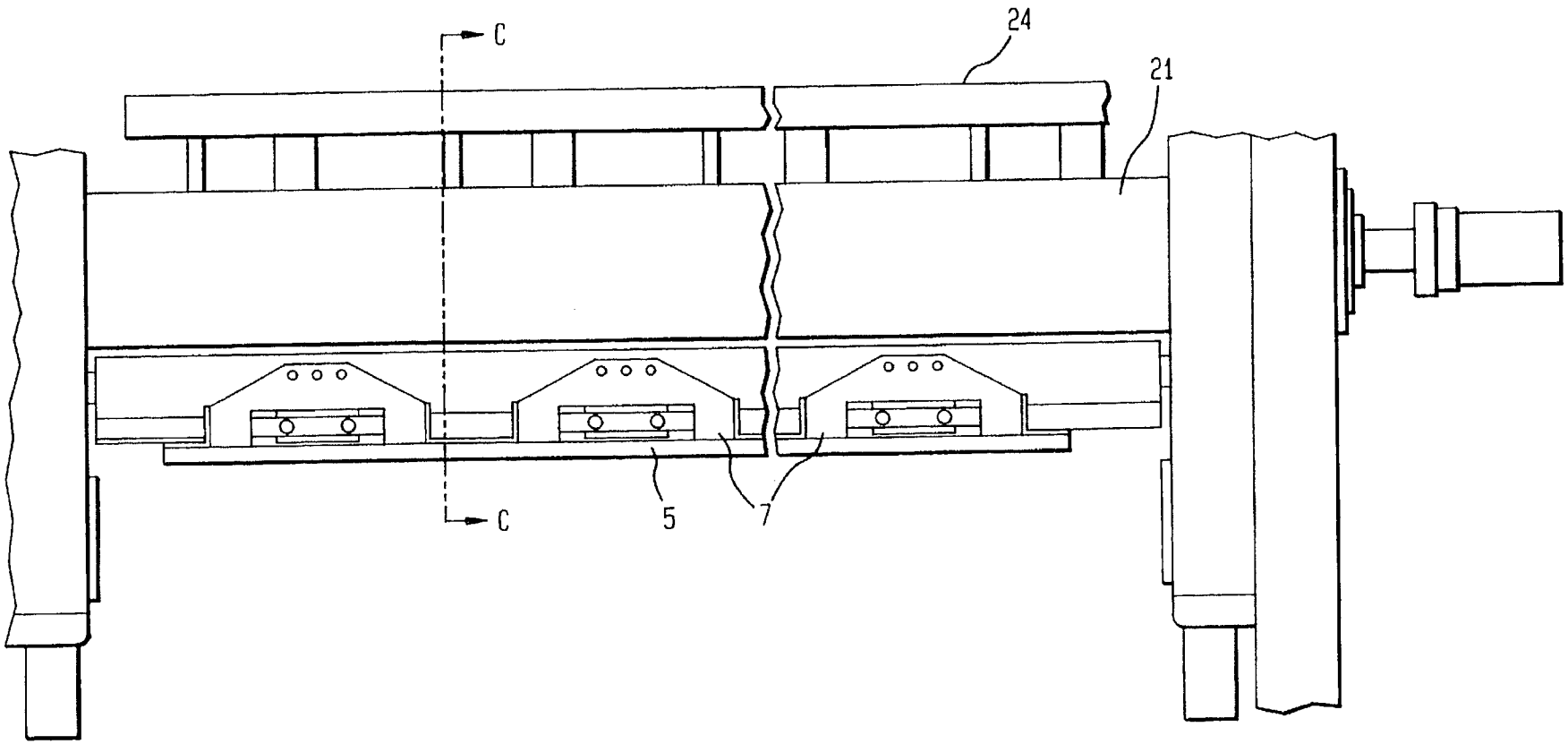
FIG. 2 shows the actuating device of the pressing station in a top view.

FIG. 2 shows the actuating device 8 of the pressing station 3 with hereon arranged press-in pliers 7 which hold a filling bar 5. The filling bars are guided in longitudinal direction of the rotatable block 12, a row of press-in pliers 7 arranged one behind another being provided.

Figure 3:
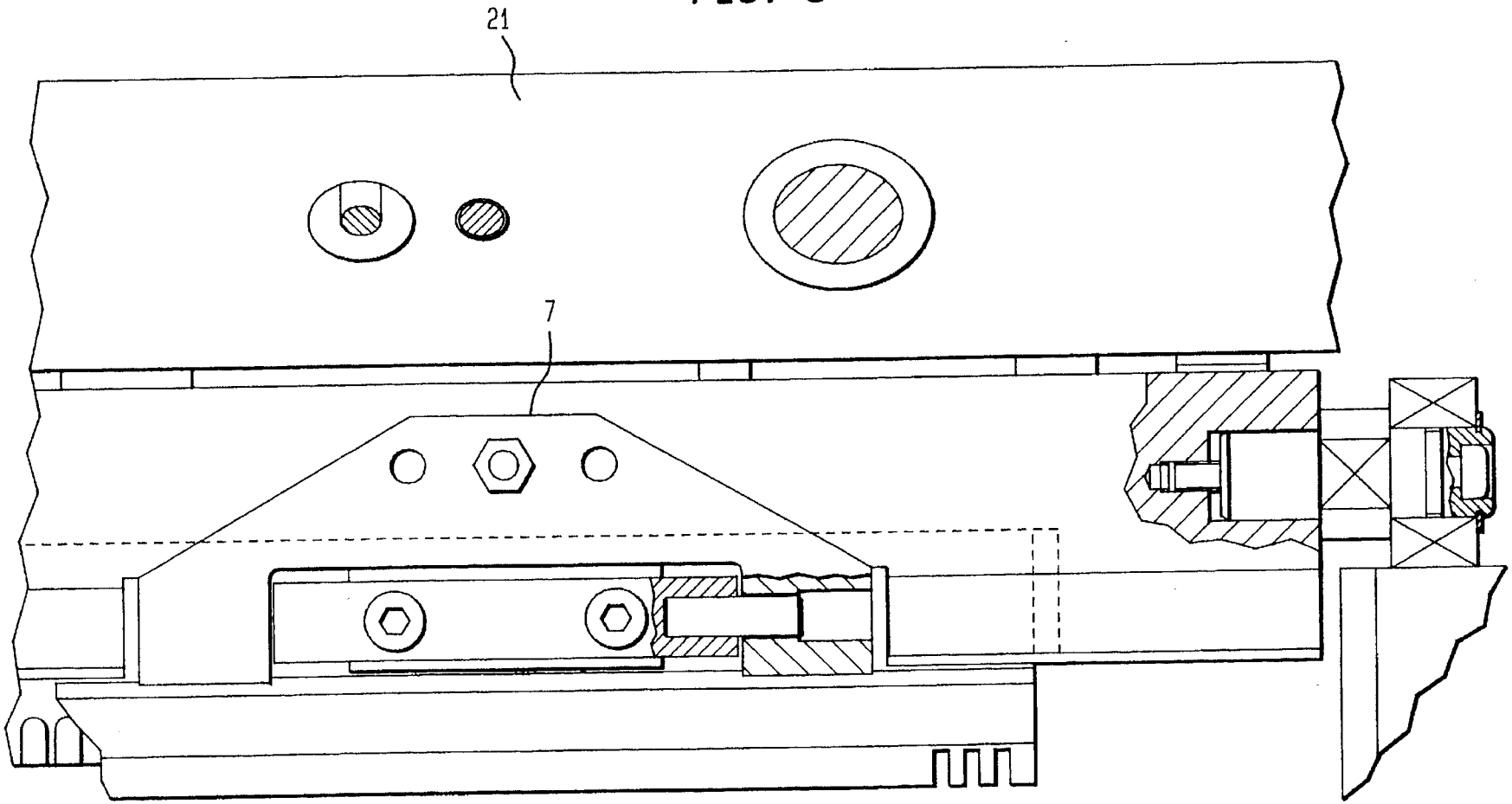
FIG. 3 shows the press-in pliers of the actuating device, with a partial section.

FIG. 3 shows these press-in pliers in an enlarged view, a partial section allowing an insight into the actuation device of these pliers which are necessary for picking up a filling bar.

Figure 4:
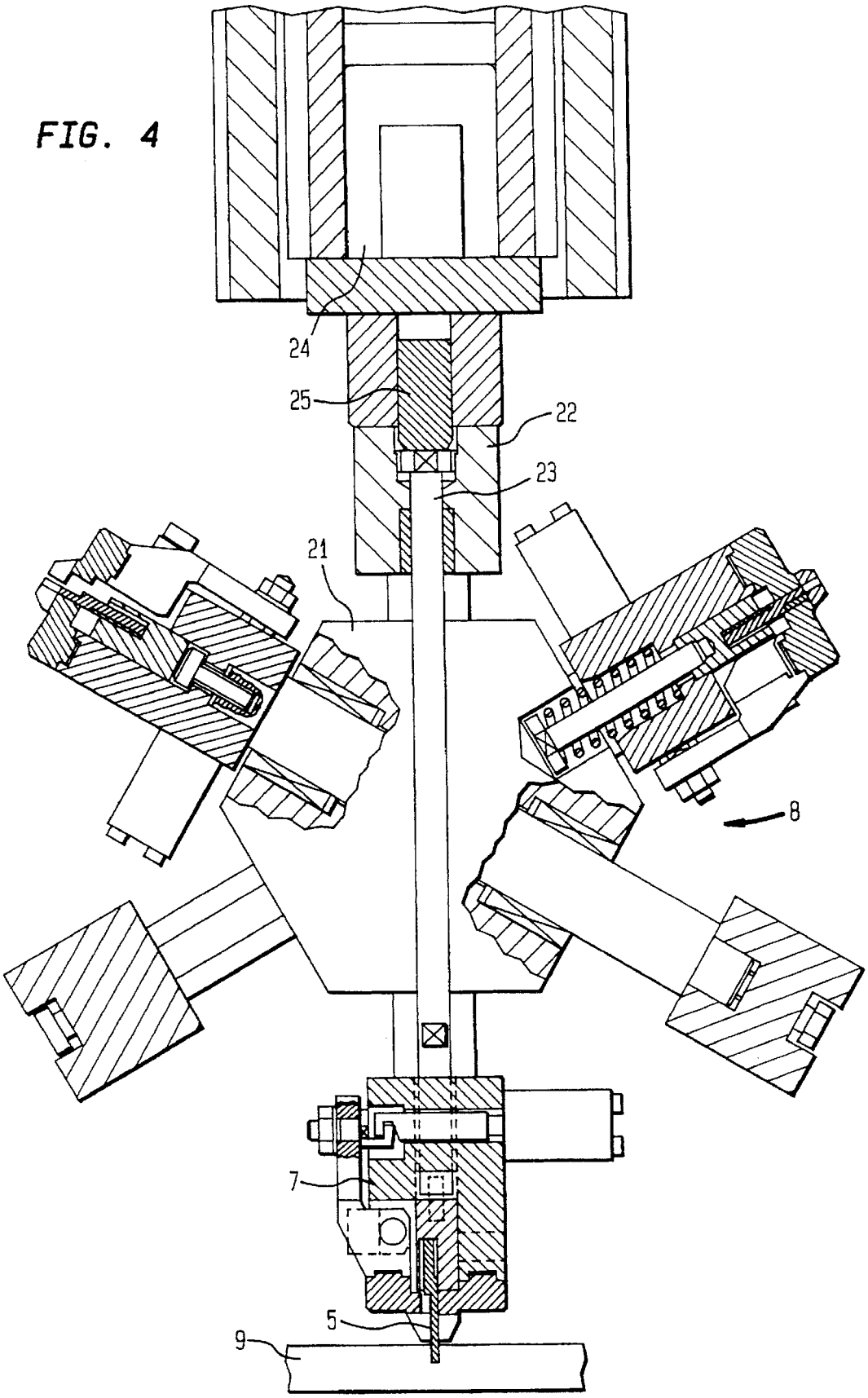
FIG. 4 shows a section through the actuating device along line C—C in FIG. 2.
Figure 5:
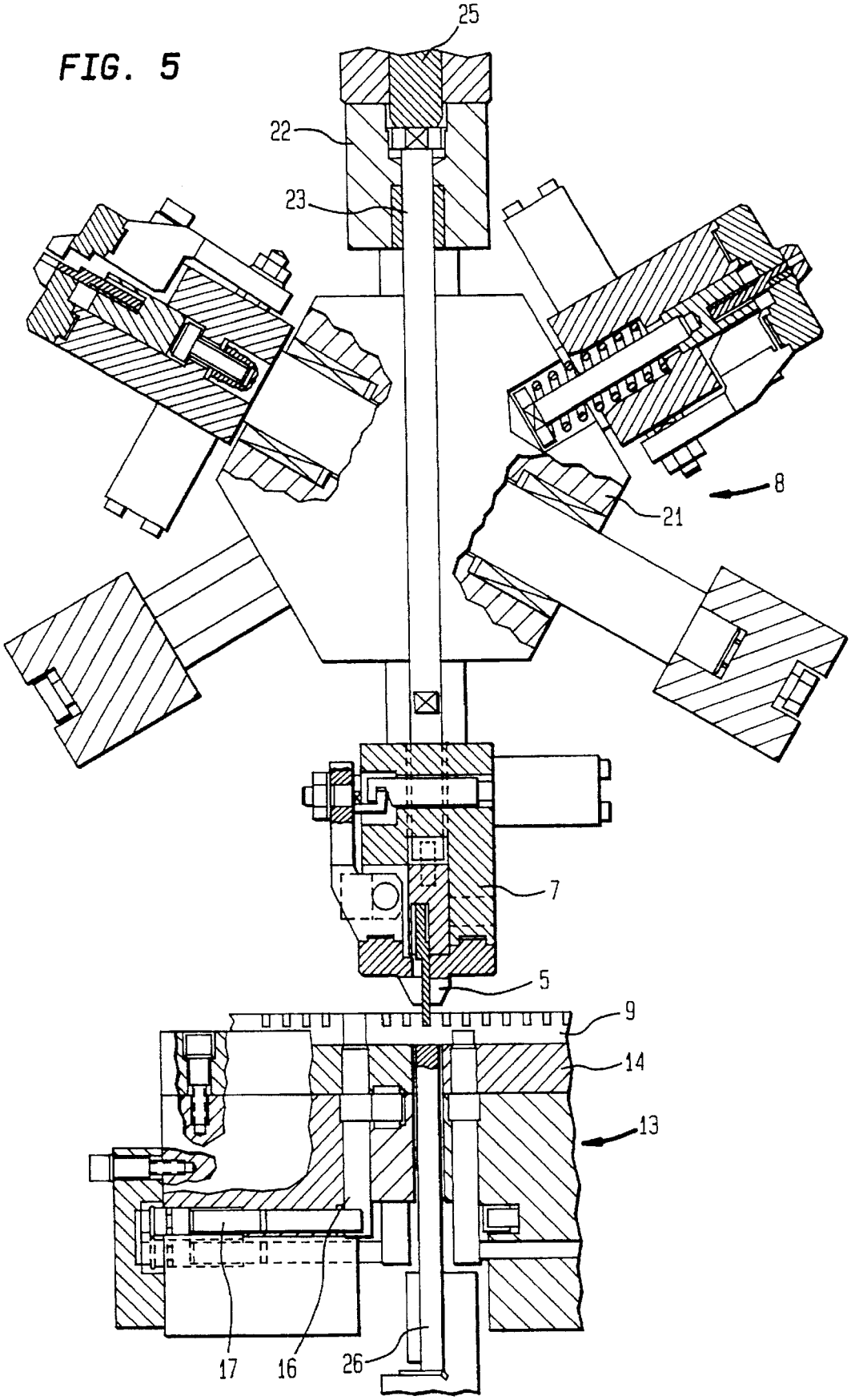
FIG. 5 shows a section similar to FIG. 4 through the entire pressing station.

A sectional view through the actuating device depicted in FIG. 2 is illustrated in FIGS. 4 and 5, the sectional view according to FIG. 5 showing the whole pressing station 3, and accordingly also the holding beam 13.

The slitted carrying bar 9 is arranged in the carrying bar support 14 of the holding beam 13. There, the carrying bar 9 is located in a groove 15. The carrying bar support 14 is provided with a plurality of parallel grooves 15. In order to correspondly fix the carrying bars 9 received in the grooves during the pressing stage, there is provided an eccentric clamping lever which is actuated hydraulically.

The eccentric clamping lever comprises a press-on shaft 16 which fixes the carrying bar 9 in the groove during a time cycle and which works together with an hydraulically operatable actuating element 17. The actuating elements 17 are supported in the holding beam and are shiftable with respect to the corresponding press-on shafts 16. Each press-on shaft 16 is arranged orthogonally with respect to the associated actuating element 17 and intermeshes with the later in such a manner that a shifting of the actuating element 17 produces a rotation of the press-on shaft. The press-on shaft 16 is heretofore provided with a meshing part 18 which works together with a groove 19 of the actuating element 17 and is surrounded by the groove. The meshing part 18 is part of the shaft cross-section and is formed in that two groove-like recesses are provided in the shaft body. Because of this, the meshing part is curved on it's peripheral side and can therefore easily move within the groove.

The press-on shafts which extend through the grooves 15 of the carrying bar guide 13 are arranged in the holding beam 13 in such a manner that the press-on shafts extending through each second groove are arranged in a row. This arrangement provides for two rows of press-on shafts.

The actuating elements 17 are also arranged staggered on the holding beam 13, in particular, in order to achieve a tight, space-saving arrangement. The press-on shafts received in neighbouring grooves 15 are rotated in opposite directions to one another.

The press-on shafts extend through the corresponding grooves 15 in an eccentric manner, that is the grooves pass through the cross section of the shaft not-centred.

The press-on shafts are provided with a fixing piece on the section which extends through the groove. The fixing piece serves to fix the corresponding carrying bar 9 in the groove. The fixing piece 20 is a cylinder segment from which a piece has been removed when viewed in axial direction of the shaft, the cross section of the fixing piece therefore corresponding to a circle segment having an area which is smaller than a half circle area. The fixing piece 20 is limited by an edge surface which extends parallel to the edges of the grooves and which in it's rest position lies outside these edges.

Figure 8:
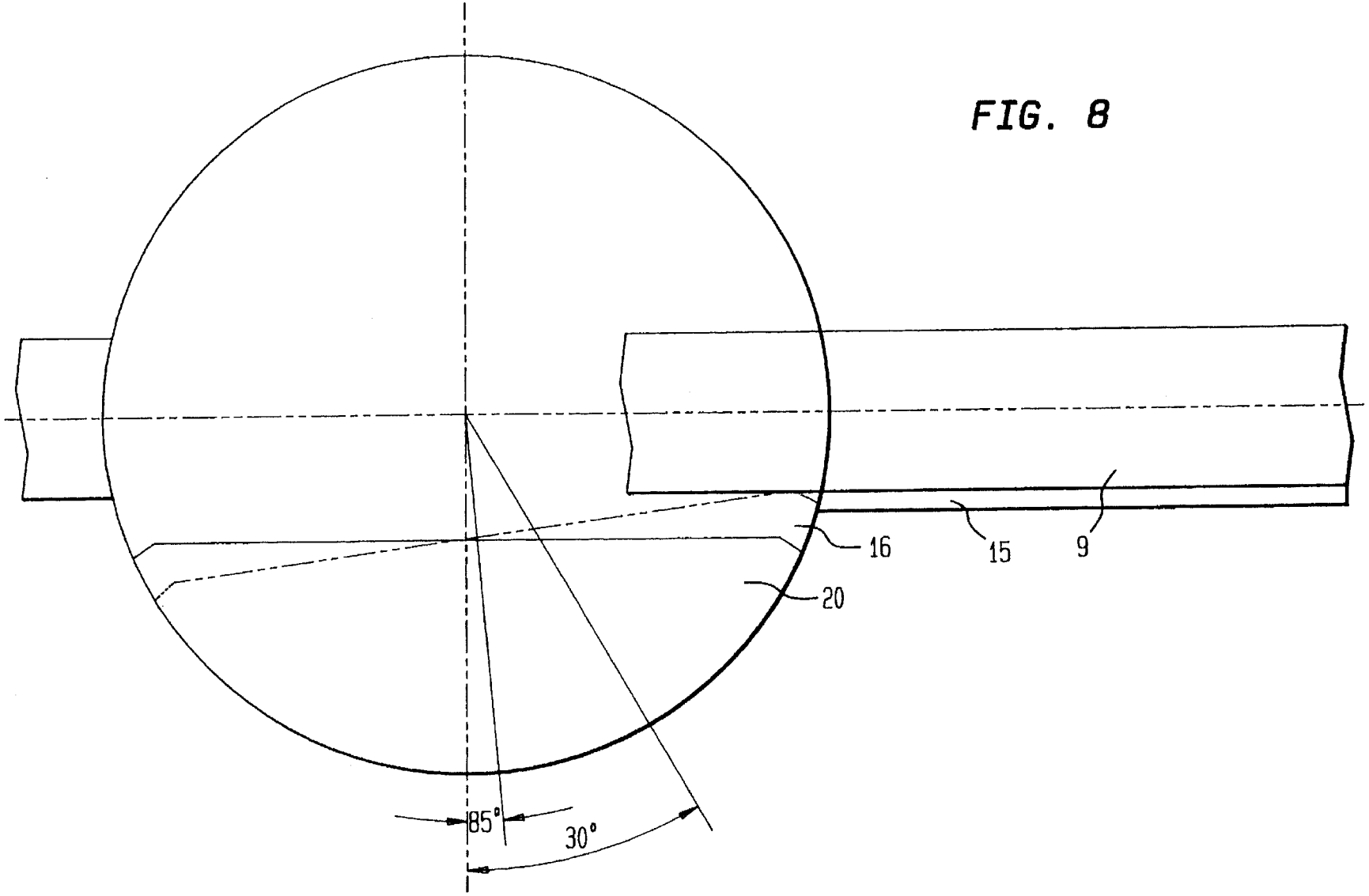
FIG. 8 shows different positions of the press-on shaft in relation to a carrying bar.
Figure 9:
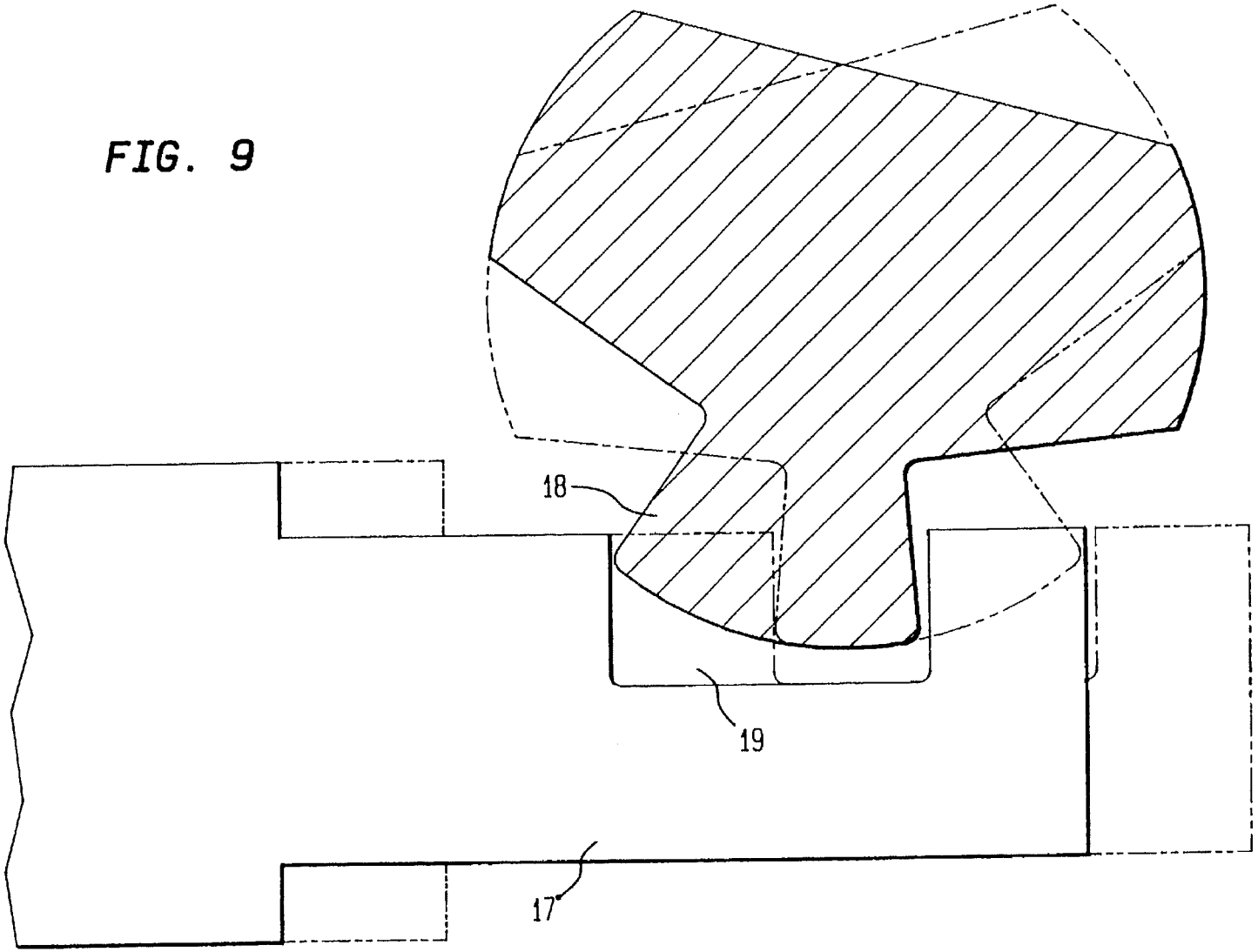
FIG. 9 shows the working interrelationship between the press-on shaft and the actuating element in different positions.

Due to this arrangement it is possible to receive carrying bars having differing thickness within the grooves, it being only necessary to rotate the press-on shaft by a corresponding different angle (FIG. 8) in order to secure the carrying bar in it's groove. It is quite possible, for example, to vary the thickness of the carrying bar 9 between 3 mm and 0.2 mm, the herefore necessary angle of rotation of the press-on shaft then being between 8.5° and 30°. It is also possible to use thicker carrying bars, for example, with a thickness from 3 mm to 8 mm, without difficulties.

It is therefore possible to produce very different grids in a simple manner, the distance between the bars of one and the same grid also being variable in this same way.

The filling bars 5 which are held by the press-in pliers 7 are subsequently pressed into the carrying bars, which have been fixed in the above described manner.

The rotatable actuating device 8 comprises a block 21 on which are arranged with 120° angular spacing from one another rows of press-in pliers arranged one behind another along the longitudinal axis of the block. These press-in pliers have the following functions in their three different rotational positions: firstly, they take over the filling bar supplied thereto, bring it into a waiting position and subsequently press the carried filling bar 5 into the carrying bar 9 secured in the holding beam 13.

In between the three rows of press-in pliers there are respectively provided docking devices extending in longitudinal direction of the block; due to this symmetrical arrangement, a press-in plier is arranged on a side face of the block opposite to a side face on which a docking device is arranged and these two elements are in connection with one another by means of a shaft 23.

In the working position, the docking device opposite to the press-in pliers which is effecting the pressing step meshes with the pressing beam 24, whereby the press-in pliers are operated by the respective corresponding press-in cylinder 25.

After the bars have been pressed together, in the process of which the filling bar 5 is inserted into the slits of the carrying bars 9, the filling bar is pressed down using the holding beam so that when the press-in pliers 7 are moved back, the filling bar 5 is prevented from moving upwards. When the press-in pliers 7 reach their initial position, namely the one before the pressing step, the actuating device 8 makes a rotation of 120° whereby the filling bar held in the waiting position is rotated into the pressing position and the free press-in pliers take over a new filling bar. At the same time, the holding beam 13 is moved forward by one division. The distance of the division can be determined and entered through a keyboard.

Figure 6:
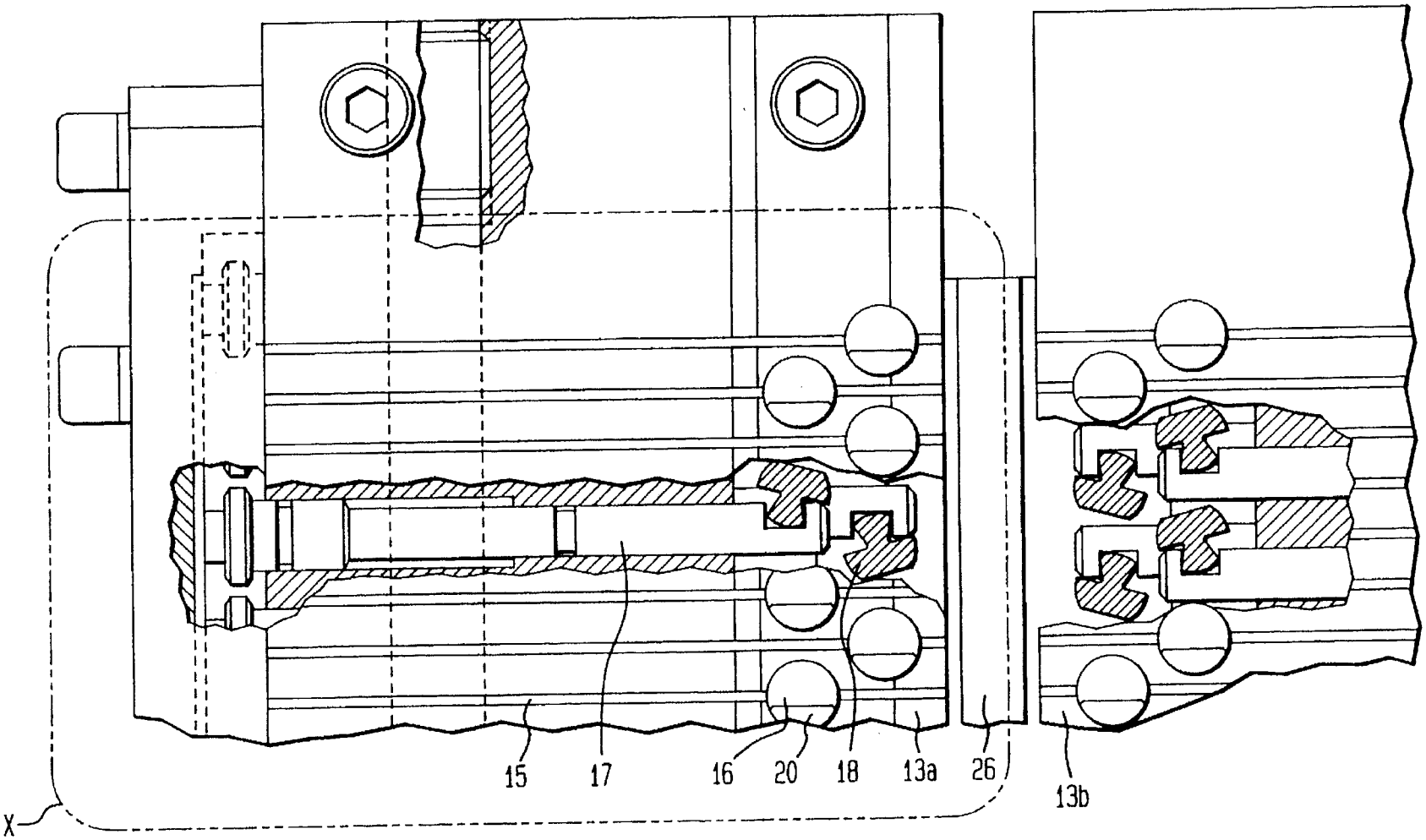
FIG. 6 shows a top view on two adjacently arranged holding beams, with a partial section.
Figure 7:
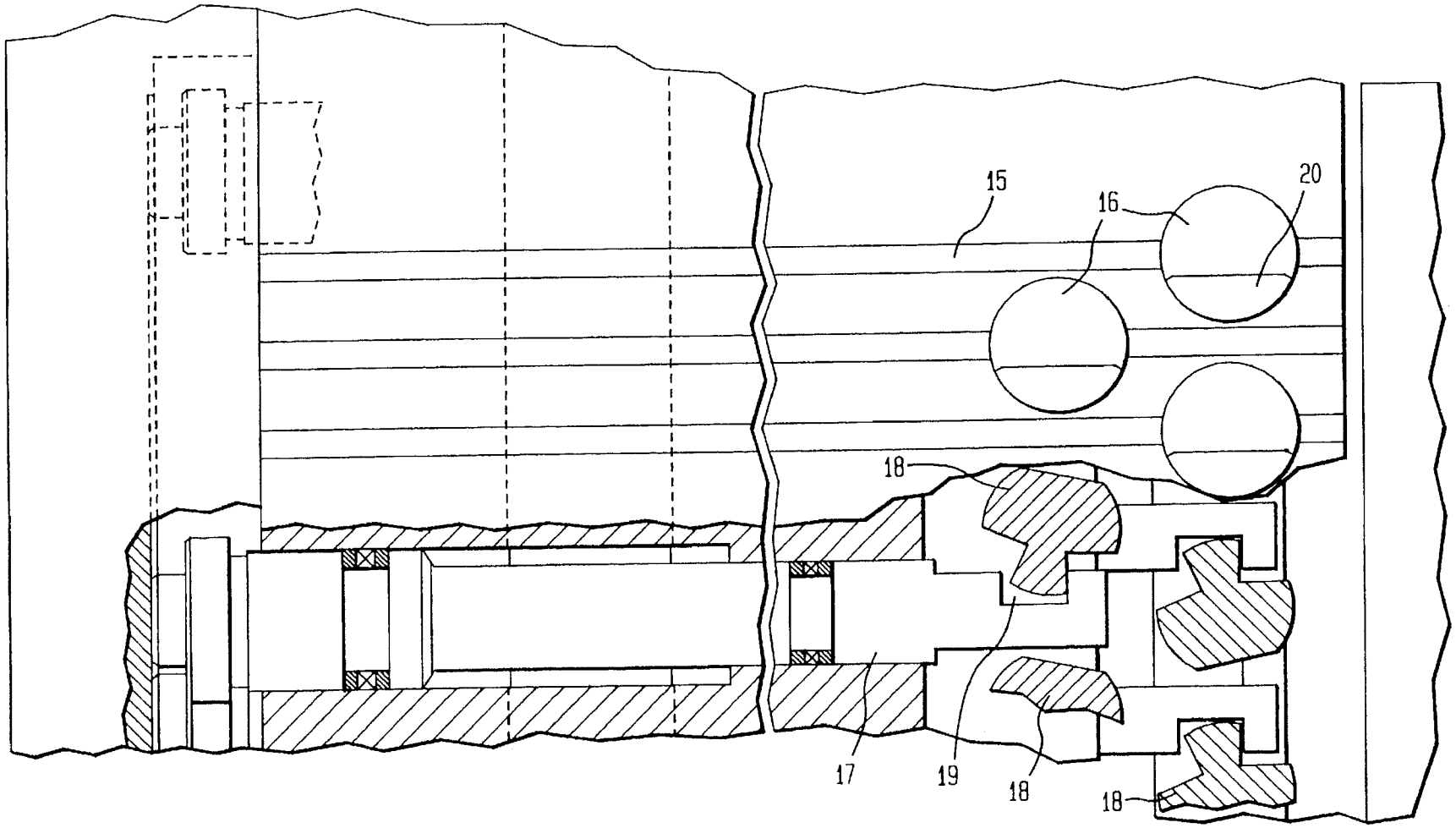
FIG. 7 shows in an enlarged view the detail X marked in FIG. 6.

The illustrations of FIG. 6 shows a top view on an embodiment in which are used two holding beams 13 arranged side-by-side, in between which is arranged a support 26 for the press-in pliers 7.

At the beginning of the pressing step, the carrying bars 9 are held at least at two pressing locations by the press-on shafts of the first holding beam 13*a*. The second holding beam 13*b* subsequently takes over the fixation of the carrying bars and the first holding beam takes over the guiding function for the carrying bars. The filling bars are pressed into the carrying bars as was previously described in a timed cycle process. The carrying bars are not released from their fixed position during the pressing and timed cycle stages. This only takes place after the last pressing step.

This ensures that the pressed together grid leaves the pressing station with correct angles in between grid bars.

The areas in which the pressed grids manufactured in accordance with this invention can be deployed are very diverse; such grids can be used its gutter grids, gully grids, aeration grids, protective grids, etc.

The claims defining the present invention are as follows:

1. Device for manufacturing a grid of a type including a plurality of carrying bars and filling bars insertable into the carrying bars, in particular for making a pressed grid, said device comprising a pressing station receiving the carrying bars and the filling bars via a supply unit, said pressing station including a holding beam for supporting the carrying bars, an actuating device for receiving the filling bars and press-fitting the filling bars in the carrying bars, wherein following the press-fitting step the holding beam is advanced by a freely selectable distance and the actuating device is moved in such a manner that a next filling bar is moved from a supply position to a working position, said actuating device being rotatable at least between one supply position and at least one working position relative to the holding beam, said device further including a transport assembly for conveying the filling bars and the carrying bars during processing in the pressing station.

2. Device according to claim 1 wherein the holding beam is provided with grooves for receiving the carrying bars and with a fixing device for fixing the carrying bars.

3. Device according to claim 2, wherein the fixed state of the carrying bars is kept during the pressing and forwarding steps.

4. Device according to claim 1 wherein the holding beam is provided with a plurality of parallel grooves.

5. Device according to claim 1 wherein the fixing device is an eccentric clamping device.

6. Device according to claim 1 wherein the eccentric clamping device comprises a press-on shaft which secures the carrying bar in the groove and an actuating element which works together with the press-on shaft.

7. Device according to claim 6, wherein the press-on shaft extends through each groove.

8. Device according to claim 7 wherein each press-on shaft extends through the groove in an eccentric manner with respect to the cross-section thereof.

9. Device according to claim 7, wherein the press-on shafts assigned to each second groove are arranged in a row.

10. Device according to claim 6, wherein the press-on shaft comprises on the section which extends through the groove a fixing piece arranged in extension of the shaft body.

11. Device according to claim 10, wherein the fixing piece is a cylindrical segment having a cross section axis extending parallel to the insertion direction of the press-on shaft in the holding beam and extending outside the groove in the non-fixed position.

12. Device according to claim 6, wherein the press-on shaft is provided in the area cooperating with the actuating element with a meshing part which is surrounded by a recess in the actuating element.

13. Device according to claim 12, wherein the meshing part is arranged within the cross section of the shaft.

14. Device according to claim 12 wherein the actuating element engages the press-on shaft in such a manner that upon longitudinal movement of the actuating element the press-on shaft rotates and the carrying bar is fixed in the groove.

15. Device according to claim 14, wherein the press-on shafts assigned to adjacently located grooves have actuating directions which are opposite to one another.

16. Device according to claim 6, wherein the actuating element is driven hydraulically.

17. Device according to claim 1 wherein the actuating device comprises a block which is rotatable about an axis and exhibits a periphery, press-in pliers arranged on the periphery of the block for receiving the filling bars and docking devices located between the press-in pliers for fixing the block in a pressing beam which includes the pressing drive.

18. Device according to claim 17, wherein the press-in pliers are arranged on the rotatable block at an angular distance from one another of 120°, one press-in pliers receiving a filling bar, a further press-in pliers being in a waiting position and the third press-in pliers pressing the filling bar with the carrying bars.

19. Device according to claim 18, wherein a plurality of press-in pliers are arranged one behind the other in longitudinal direction of the block and the filling beams.

20. Device according to claim 17, wherein the press-in pliers are operated by press-in cylinders.

21. Device according to claim 20, wherein the press-in cylinders are arranged on the pressing beam which fixes the rotatable block during the press-in operation.

22. Device according to claim 17, with two holding beams being separated from one another by a support for the press-in pliers wherein the carrying bars are fixed during the first pressing step by the first holding beam, and during all further pressing steps by the second holding beam, with the first holding beam serving as a guide for the carrying bars.

23. Device according to claim 22 wherein the carrying bars are fixed during the first two pressing steps.

* * * * *